US009616699B2

(12) United States Patent
Garnier et al.

(10) Patent No.: US 9,616,699 B2
(45) Date of Patent: Apr. 11, 2017

(54) METHODS FOR PRINTING TACTILE SECURITY FEATURES

(71) Applicant: SICPA HOLDING SA, Prilly (CH)

(72) Inventors: Christophe Garnier, Reignier (FR); Lucien Vuilleumier, Begnins (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 299 days.

(21) Appl. No.: 14/406,903

(22) PCT Filed: Apr. 16, 2013

(86) PCT No.: PCT/EP2013/057904

§ 371 (c)(1),
(2) Date: Dec. 10, 2014

(87) PCT Pub. No.: WO2013/185950

PCT Pub. Date: Dec. 19, 2013

(65) Prior Publication Data

US 2015/0174945 A1 Jun. 25, 2015

(30) Foreign Application Priority Data

Jun. 11, 2012 (EP) ..... 12171469

(51) Int. Cl.

| | |
|---|---|
| ***B41J 29/393*** | (2006.01) |
| ***B42D 25/378*** | (2014.01) |
| ***B41M 3/14*** | (2006.01) |
| ***B42D 25/29*** | (2014.01) |
| ***B42D 25/364*** | (2014.01) |
| ***B42D 25/369*** | (2014.01) |
| ***B42D 25/382*** | (2014.01) |
| ***B42D 25/405*** | (2014.01) |
| *B41M 1/04* | (2006.01) |
| *B41M 1/10* | (2006.01) |
| *B41M 1/12* | (2006.01) |
| *B41M 3/16* | (2006.01) |
| *B41M 7/00* | (2006.01) |

(52) U.S. Cl.

CPC ..... *B42D 25/378* (2014.10); *B41M 3/14* (2013.01); *B41M 3/144* (2013.01); *B42D 25/29* (2014.10); *B42D 25/364* (2014.10); *B42D 25/369* (2014.10); *B42D 25/382* (2014.10); *B42D 25/405* (2014.10); *B41M 1/04* (2013.01); *B41M 1/10* (2013.01); *B41M 1/12* (2013.01); *B41M 3/148* (2013.01); *B41M 3/16* (2013.01); *B41M 7/0081* (2013.01); *B42D 2033/16* (2013.01); *Y10T 428/24355* (2015.01)

(58) Field of Classification Search

CPC ..... B41M 5/52; B41M 5/5254; B41M 5/5218
See application file for complete search history.

(56) References Cited

U.S. PATENT DOCUMENTS

| | | | | |
|---|---|---|---|---|
| 5,211,877 | A | 5/1993 | Andrejewski et al. | |
| 5,362,315 | A | 11/1994 | Muller-Rees et al. | |
| 6,423,246 | B1 | 7/2002 | Kasch et al. | |
| 6,565,770 | B1 | 5/2003 | Mayer et al. | |
| 6,644,763 | B1 | 11/2003 | Gothait | |
| 7,108,742 | B2 | 9/2006 | Hall-Goulle et al. | |
| 7,357,077 | B2 | 4/2008 | Adamczyk et al. | |
| 7,618,066 | B2 | 11/2009 | Baldus et al. | |
| 8,247,063 | B2 * | 8/2012 | Holbert | B32B 7/06 428/195.1 |
| 8,758,548 | B2 * | 6/2014 | Kronzer | B29C 33/68 156/325 |
| 2005/0115425 | A1 | 6/2005 | Plaschka et al. | |
| 2005/0123705 | A1 | 6/2005 | Dronzek, Jr. et al. | |
| 2008/0250973 | A1 | 10/2008 | Leenders et al. | |
| 2009/0155483 | A1 | 6/2009 | Mariotti et al. | |
| 2010/0002303 | A1 | 1/2010 | Vast et al. | |
| 2010/0219626 | A1 | 9/2010 | Dietemann | |
| 2011/0049865 | A1 | 3/2011 | Bray | |
| 2012/0133121 | A1 | 5/2012 | Bleikolm et al. | |
| 2012/0171603 | A1 | 7/2012 | Heilman et al. | |
| 2013/0200606 | A1 | 8/2013 | Omar | |

FOREIGN PATENT DOCUMENTS

| | | |
|---|---|---|
| CA | 2714639 A | 8/2009 |
| CN | 1788057 A | 6/2006 |

(Continued)

OTHER PUBLICATIONS

Chinese Office action in related Application No. 20130030499.4, dated Nov. 4, 2015, with English-language translation.

(Continued)

*Primary Examiner* — Lamson Nguyen
(74) *Attorney, Agent, or Firm* — Greenblum & Bernstein, P.L.C.

(57) ABSTRACT

A process for manufacturing a security feature having a tactile pattern, said method including applying on a substrate a radiation-curable basecoat composition by a process selected from inkjet, offset, screen printing, flexo printing and rotogravure; at least partially or fully radiation-curing the radiation-curable basecoat composition so as to obtain a radiation-cured basecoat; applying on the radiation-cured basecoat a radiation-curable topcoat composition in a form of indicia by a process of screen printing, flexo printing or rotogravure; radiation-curing said radiation-curable topcoat composition so as to form a radiation-cured topcoat. The radiation-curable basecoat composition and/or the radiation-curable topcoat composition includes one or more machine readable feature substances independently selected from cholesteric liquid crystal pigments, luminescent compounds, infrared-absorbing compounds, magnetic compounds and mixtures thereof. The radiation-cured basecoat has a surface energy at least 15 mN/m less than the surface energy of the radiation-cured topcoat.

24 Claims, No Drawings

(56) References Cited

FOREIGN PATENT DOCUMENTS

| | | | |
|---|---|---|---|
| CN | 101209608 | A | 7/2008 |
| CN | 101291816 | A | 10/2008 |
| CN | 101977778 | A | 2/2011 |
| CN | 102448730 | A | 5/2012 |
| CN | 102481801 | A | 5/2012 |
| DE | 102006012329 | | 9/2007 |
| EP | 0601483 | | 6/1994 |
| EP | 0687771 | | 12/1995 |
| EP | 1046692 | | 10/2000 |
| EP | 1213338 | | 6/2002 |
| EP | 1525993 | | 4/2005 |
| EP | 1676715 | | 7/2006 |
| TW | 201036830 | | 10/2010 |
| TW | 201217186 | | 5/2012 |
| WO | WO2007/045578 | | 4/2007 |
| WO | 2007/060133 | | 5/2007 |
| WO | 2008/000755 | | 1/2008 |
| WO | 2008/033059 | | 3/2008 |
| WO | 2008/092522 | | 8/2008 |
| WO | 2009/005733 | | 1/2009 |
| WO | 2010/071956 | | 7/2010 |
| WO | 2010/071992 | | 7/2010 |
| WO | 2010/071993 | | 7/2010 |
| WO | 2010/115986 | | 10/2010 |
| WO | 2010/149476 | | 12/2010 |
| WO | 2011/001200 | | 1/2011 |
| WO | WO2011/107527 | | 9/2011 |
| WO | WO2012/038531 | | 3/2012 |

OTHER PUBLICATIONS

Taiwan office action and search report in counterpart Taiwan Application No. 102119906 dated Aug. 24, 2016 (and English language translation).

* cited by examiner

METHODS FOR PRINTING TACTILE SECURITY FEATURES

CROSS-REFERENCE TO RELATED APPLICATIONS

The present application is a U.S. National Stage of International Application No. PCT/EP2013/057904, filed Apr. 16, 2013, which published as WO 2013/185950A1 on Dec. 19, 2013, the disclosure of which is expressly incorporated by reference herein in its entirety. Further, this application claims priority under 35 U.S.C. §119 and §365 of European Application No. 12171469.5, filed Jun. 11, 2012.

FIELD OF THE DISCLOSURE

The present disclosure relates to the field of the protection of value documents and value commercial goods against counterfeit and illegal reproduction. In particular, the present disclosure is related to the field of methods to impart a combination of a tactile feature and a security feature in security documents, and security documents obtained therefrom.

BACKGROUND OF THE DISCLOSURE

With the constantly improving quality of color photocopies and printings and in an attempt to protect security documents such as banknotes, value documents or cards, transportation tickets or cards, tax banderols, and product labels that have no reproduceable effects against counterfeiting, falsifying or illegal reproduction, it has been the conventional practice to incorporate various security measures in these documents. Typical examples of security measures include security threads, windows, fibers, planchettes, foils, decals, holograms, watermarks, security inks comprising optically variable pigments, magnetic or magnetizable thin-film interference pigments, interference-coated particles, thermochromic pigments, photochromic pigments, luminescent, infrared-absorbing, ultraviolet-absorbing or magnetic compounds. In addition to those security features, security documents often carry a tactilely-detectable or feelable surface profile pattern. In addition to the fact that tactile features cannot be imitated by copying machines, they have the further advantage that visually impaired people might use them as a distinguishing and identification feature.

Tactile patterns and features have been produced using different technologies including intaglio printing, inkjet printing and screen printing.

Intaglio printing is used in the field of security documents, in particular banknotes, and confers the well-known and recognizable relief features, in particular the unmistakable touch feeling, to a printed document. Intaglio printing has been used to print tactile features for visually impaired persons, e.g., in EP 1 525 993 A1 and U.S. Pat. No. 7,357,077 B2. U.S. Pat. No. 7,618,066 B2 discloses a printed carrier having a printed surface and at least one printed partial surface enclosed thereby, both surfaces being printed by an intaglio process and contrasting visually in terms of brightness, for example due to an ink layer of varying thickness. In addition to the contrasting effect, both surfaces are said to be distinguishable with the sense of touch, i.e. tactilely. The disclosed data carrier comprising the surfaces is printed with the same ink but in different thickness.

US-2005/0115425 A1 discloses a data carrier printed by an intaglio process exhibiting a tactile feature. It is further disclosed that images printed by rotogravure (also described in the art as heliogravure) have no tactility due to the lack of viscosity of the ink and the low contact pressure during the printing process, thus preventing relief formation.

Inkjet printing has been used to print tactile features. U.S. Pat. No. 6,644,763 B1 and US-2009/0155483 A1 disclose inkjet printing methods for creating raised effects by applying a light curable adhesive or ink on a substrate. EP-1 676 715 A1 discloses a data carrier with a tactile feature applied by an inkjet printing process; the tactile feature may contain dyes or pigments so as to allow visual inspection and/or automated inspection. WO 2010/149476 A1 discloses a security element comprising a data consisting of a first region having a first color $T_1$ and at least a second region having a second color $T_2$ different from $T_1$, wherein both regions are differentially covered, in particular by an inkjet printing process, with a transparent or translucent material so as to form a raised tactile element.

WO 2010/071993 A1 discloses a method for making tactile patterns on a substrate by applying by screen printing or inkjet printing a UV-curable deposit material having a viscosity in the range of 2000 to 25000 cP at 25° C. onto said substrate. The disclosed UV-curable deposit material, which may further comprise a taggant so as to increase the level of security of a security document comprising said material, is said to exhibit high adhesion due to the presence of a low viscosity acrylate component, an adhesion-promoting acid acrylate and a rheological adsorbing additive such as fumed silica or precipitated gel silica. WO 2010/071956 A1 and WO 2010/071992 A1 disclose a method for printing a tactile mark on a substrate comprising a step of screen printing a UV-curable ink deposit and curing said ink, and a step of intaglio calendering or printing so as to form protrusions in the substrate on the opposite side of the ink deposit.

Alternatively, a method of imparting a tactile effect by modifying the substrate itself has been developed. EP 0 687 771 A2 discloses a security paper carrying an intricate tactile surface profile pattern which has been imparted to the paper during the manufacture by using a nip. A fluorescent ink might be applied on the paper carrying the tactile pattern. However, the freedom to change the design of the tactile pattern from one process to another one is limited and it requires the alignment and/or registration of the fluorescent ink on the tactile feature, which might be tedious and time-consuming.

Alternatively, several systems include the use of particles to impart or create a tactile effect. DE 102006012329 A1 discloses inks for flexo and offset printing comprising heat and infrared expandable microspheres and infrared absorber for the production of tactile effect. US-2010/0002303 A1 discloses a security device comprising at least one zone having an interference effect and at least one tactile recognition element located in the same region. The tactile recognition element comprises particles partially incorporated into the zone having an interference effect. Consequently, the tactile effect as a security feature arises from particles sticking out the zone having the interference effect. US-2010/0219626 A1 discloses a security sheet including an iridescent security mark comprising iridescent pigments, wherein said mark may include a tactile-effect element constituted by a polyurethane (PU), in particular PU microspheres or PU in an aqueous dispersion of PU (latex) or by the iridescent pigments. US-2011/0049865 A1 discloses a security document comprising a security feature having an inherent tactile nature, said security feature comprising a printed layer with particles protruding at least ten μm (microns) therefrom and in an amount of at least three particles per $mm^2$ of the layer. Due to the inherent tactile nature of the security feature, it is disclosed that any technique including screen, lithography, letterpress, flexo, gravure and or intaglio printing might be used. The disclosed security feature could be provided with both human and machine-readable feature.

However, systems including the use of particles to create a tactile effect might have drawbacks including for example a reduction of the color strength of the printed document and a poor scratch and scuff resistance resulting in the loss of the tactile feature upon use and time.

WO 2011/001200 A1 discloses a packaging for consumer goods having a discontinuous tactile coating. The discontinuous tactile coating is formed by applying, such as for example by gravure, offset, flexo, lithographic or screen printing, one or more varnishes or tinted varnishes to the outer surface of the packaging.

As described hereabove, several solutions have been developed to produce tactile pattern on security documents; however, these solutions may suffer from drawbacks that have been cited. Therefore, a need remains for methods for manufacturing a security document combining tactility and a machine detectable or machine readable security feature while highly increasing resistance to counterfeiting and illegal reproduction and maintaining an easy and economic manufacturing process.

SUMMARY OF EMBODIMENTS OF THE DISCLOSURE

It has been surprisingly found that security features combining a radiation-cured basecoat made of a radiation-curable basecoat composition and a radiation-cured topcoat made of a radiation-curable topcoat composition in the form of indicia being tactilely readable advantageously exhibit a strongly improved forgery-proofness due to the presence of a machine readable feature substance comprised in the radiation-cured basecoat and/or the radiation-cured topcoat and/or in both. By being tactilely readable, the indicia on the security feature attract the attention of people to region(s) bearing a tactile recognition element and thus motivate them to verify the authenticity of the security feature or security document comprising said security feature by using a machine, device, detector or other external aid and check the machine readable feature substance embedded either in the radiation-cured topcoat, in the radiation-cured basecoat or in both. The tactility alone or the combination of the tactility and machine readable properties of the security feature or security document comprising said security feature may advantageously be also used by visually impaired people to verify the authenticity of said security feature or said security document.

In a first aspect, the disclosure provides a process for manufacturing a security feature and security features obtained therefrom, said security feature comprising a tactile pattern, said method comprising the steps of:

i) applying on a substrate a radiation-curable basecoat composition by a process selected from the group consisting of inkjet, offset, screen printing, flexo printing and rotogravure;

ii) at least partially or fully radiation-curing said radiation-curable basecoat composition so as to obtain a radiation-cured basecoat;

iii) applying on the radiation-cured basecoat obtained under step ii) a radiation-curable topcoat composition in a form of indicia by a process selected from the group consisting of screen printing, flexo printing and rotogravure;

iv) radiation-curing said radiation-curable topcoat composition so as to form a radiation-cured topcoat;

wherein the radiation-curable basecoat composition and/or the radiation-curable topcoat composition comprises one or more machine readable feature substances independently selected from the group consisting of cholesteric liquid crystal pigments, luminescent compounds, infrared-absorbing compounds, magnetic compounds and mixtures thereof, wherein the radiation-cured basecoat has a surface energy at least 15 mN/m less than the surface energy of the radiation-cured topcoat.

In a second aspect, the disclosure provides a security feature comprising a substrate and a tactile pattern of a radiation-cured basecoat and a radiation-cured topcoat, said radiation-cured topcoat being in the form of indicia and at least partially covering said radiation-cured basecoat, wherein said radiation-cured basecoat and/or said radiation-cured topcoat comprises at least one machine-readable feature substance, characterized in that said basecoat has a surface energy of at least 15 mN/m less than the surface energy of the topcoat, wherein said basecoat and said topcoat are made from radiation-curable compositions.

In a third aspect, the disclosure provides a use of the security feature described above for the protection of a security document against counterfeiting or fraud.

In a fourth aspect, the disclosure provides a security document comprising the security feature described above.

DETAILED DESCRIPTION

The following definitions are to be used to interpret the meaning of the terms discussed in the description and recited in the claims.

As used herein, the article "a" indicates one as well as more than one and does not necessarily limit its referent noun to the singular.

As used herein, the term "about" indicates that the amount or value in question may be the value designated or some other value about the same. The phrase is intended to convey that similar values within a range of ±5% of the indicated value promote equivalent results or effects according to embodiments of the disclosure.

As used herein, the term and/or indicates that either all or only one of the elements of said group may be present. For example, "A and/or B" shall mean "only A, or only B, or both A and B".

As used herein, the term "indicia" refers to discontinuous layers such as patterns, including without limitation symbols, alphanumeric symbols, motifs, letters, words, numbers, logos and drawings.

As used herein, the term "machine readable feature substance" refers to a material that exhibits at least one distinctive property that is not perceptible by the naked eye, and which can be admixed to or comprised in an ink or composition so as to confer a way to authenticate said ink/composition or article comprising said ink/composition by the use of a particular equipment for its authentication.

As used herein, the term "security feature substance" refers to a material that can be admixed to or comprised in an ink or composition and so as to confer a security feature on a security document for the purpose of determining its authenticity and protecting it against counterfeits and illegal reproduction.

The term "composition" refers to any composition that is capable of forming a coating on a solid substrate, and which can be applied preferentially but not exclusively by a printing method.

Described herein is a process for manufacturing security features comprising tactile readable indicia that advantageously combine tactile readable characteristics with one or more machine readable semi-covert or covert feature substances and security documents obtained therefrom. The security features obtained from the processes according to the present disclosure comprise a substrate, a radiation-cured basecoat and a radiation-cured topcoat, wherein the radiation-cured basecoat faces the substrate and the radiation-cured topcoat faces the radiation-cured basecoat and the environment. The security features and security documents comprising said security features exhibit a strongly improved forgery-proofness due to the combination of tactilely perceptible features and machine-readable security features. In addition, the tactile effect of the security feature obtained by the presence of a tactile pattern attracts the attention of people or guide them to region(s) bearing a tactile recognition element, and thus motivates them to verify the authenticity of the security feature of security document comprising said security feature by using a machine and check the machine readable feature substance embedded either in the radiation-cured topcoat, the radiation-cured basecoat or in both.

The term "security document" refers to a document that is usually protected against counterfeit or fraud by at least one security feature. Examples of security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, bank cards, credit cards, transactions cards, access documents, entrance tickets and the like. The term "value commercial good" refers to packaging material, in particular for pharmaceutical, cosmetics, electronics or food industry that may comprise one or more security features in order to warrant the content of the packaging like for instance genuine drugs. Example of these packaging material include without limitation labels such as authentication brand labels, tamper evidence labels and seals.

Security documents are usually protected by several layers of different security elements, which are chosen from different technology fields, manufactured by different suppliers, and embodied in different constituting parts of the security document. To break the protection of the security document, the counterfeiter would need to obtain all of the implied materials and to get access to all of the required processing technology, which is a hardly achievable task.

The term "tactile pattern" refers to a surface feature giving a distinctive texture to a document. The distinctive texture includes a relief structure on a surface which can be felt or recognized by the sense of touch.

With the aim of increasing the feelable aspect of the tactile pattern, the tactile pattern has preferably a relief height of at least 20 μm (microns), preferably at least 30 μm (microns), more preferably between about 20 and about 50 μm (microns) and still more preferably between about 20 and about 40 μm (microns), wherein "relief height" refers to the extent of the tactile pattern in a direction perpendicular to the unprinted substrate, surface or area. In other words, the tactile pattern has preferably a peak to valley distance of at least 20 μm (microns), more preferably at least 30 μm (microns) and more preferably between about 20 and about 50 μm (microns) and still more preferably between about 20 and about 40 μm (microns). As used herein, the term "peak" refers to the highest protrusion of the tactile pattern from the surface to which it is applied. As used herein, the term "valley" refers to the lowest protrusion of the tactile pattern from the surface to which it is applied.

Security features and security documents comprising said security features described herein comprise a tactile pattern that can be recognized tactilely or sense of touch (hereafter summarized as tactile effect), and which is created by the specific combination of the radiation-cured basecoats and radiation-cured topcoats described herein.

With the aim of optimizing the tactile pattern, thereby attracting the attention of people to region(s) bearing a tactile recognition element and motivating them to verify the authenticity of the security document by using a machine, device, detector or other external aid to check the machine readable feature substance embedded either in the radiation-cured topcoat, in the radiation-cured basecoat or in both, the radiation-cured basecoat has a surface energy at least 15 mN/m, preferably at least 20 mN/m, and more preferably between about 15 and about 35 mN/m, less than the surface energy of the radiation-cured topcoat. Preferably, the radiation-cured basecoat has a surface energy between about 20 and about 35 mN/m and the radiation-cured topcoat has a surface energy between about 40 and about 60 mN/m, provided that the radiation-cured basecoat has a surface energy at least 15 mN/m, preferably at least 20 mN/m and more preferably between about 15 and about 35 mN/m less than the surface energy of the radiation-cured basecoat. Surface energies are determined at 22° C. according to the Owen-Wendt-Rabel-Kaelbe (OWRK) method (Owens D. K. and Wendt R. C., 1969, J. Appl. Polym. Sci. 13, 1741) by static angle measurement using the sessile drop method and deionized water, diiodomethane and ethylene glycol as test liquids. Surface energies are determined through contact angle measurements by using deionized water, diiodomethane and ethylene glycol as test liquids. Surface energies are calculated by using the Owen-Wendt-Rabel-Kaelbe (OWRK) theory. Typically, surface energies can be determined by using Contact Angle Measuring Systems such as those sold by Krüss.

Suitable substrates for use in the present disclosure include without limitation paper or other fibrous materials, such as cellulose, paper-containing materials, plastic or polymer substrates, composite materials, metals or metalized materials and combinations thereof. Typical examples of plastic or polymer substrates are polypropylene (PP), polyethylene (PE), polycarbonate (PC), polyvinyl chloride (PVC) and polyethylene terephthalate (PET). Typical examples of composite materials include without limitation multilayer structures or laminates of paper and at least one plastic or polymer material. With the aim of further increasing the security level and the resistance against counterfeiting and illegal reproduction of security features and security documents, the substrate may contain watermarks, security threads, fibers, planchettes, luminescent compounds, windows, foils, decals, coatings and combinations thereof. Should the adhesion between the substrate and the radiation-cured basecoat be insufficient due to, for example, the substrate material, a surface unevenness or a surface inhomogeneity, an additional layer or a primer between the substrate and the radiation-cured basecoat might be applied as known for those skilled in the art. Alternatively, the substrate of the security feature described herein may be an auxiliary substrate, such as for example, a security thread, security stripe, a foil, a decal, a window or a label which may be consequently transferred to a security document in a separate step.

The radiation-cured basecoats described herein may be continuous or discontinuous layers such as strips, any patterns or indicia. The radiation-cured basecoats described herein are made of a radiation-curable basecoat composition. The radiation-curable topcoat compositions described herein are applied in the form of indicia on the radiation-cured basecoat which is radiation-cured as described herein by a process selected from the group consisting of screen printing, flexo printing and rotogravure. Preferably, the radiation-cured topcoats described herein at least partially or fully cover or superimpose the radiation-cured basecoat. The term "partially cover" or "partially superimpose" indicates that the two compositions or layers are applied on top of each other in a partial overlapping position and are in intimate contact in the overlapping position(s). The term "fully cover" or "fully superimpose" indicates that the two layers are applied on top of each other in an absolute overlapping position and are in intimate contact.

The radiation-cured topcoats described herein are made of the radiation-curable topcoat compositions described herein in the form of indicia, i.e. discontinuous layers such as patterns including without limitation symbols, alphanumeric symbols, motifs, letters, words, numbers, logos and drawings. Indeed, topcoats including indicia, i.e. discontinuous layers, where zone(s) having a tactile effect is(are) contiguous to zone(s) lacking a tactile effect lead to an increased perception of the tactile pattern, i.e. the tactilely readable characteristics of the indicia, of the security feature.

The radiation-curable basecoat compositions and radiation-curable topcoat compositions described herein refer to compositions that might be cured by UV-visible light radiation (hereafter referred as UV-Vis-curable) or by E-beam radiation (hereafter referred as EB). Preferably, the radiation-curable basecoat compositions and radiation-curable topcoat compositions described are cured by UV-visible light radiation (hereafter referred as UV-Vis-curable). Radiation curing advantageously leads to very fast curing processes and hence drastically decreases the preparation time of security features and security documents comprising said security features. The radiation-curable basecoat compositions are at least partially or fully radiation-cured and the radiation-curable topcoat compositions described herein are radiation-cured as known to the skilled person so as to form the radiation-cured basecoats and radiation-cured topcoats described herein. The term "curing" or "curable" refers to processes including the drying or solidifying, reacting or polymerization of the applied composition in such a manner that it can no longer be removed from the surface onto which it is applied.

Radiation-curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. Preferably, the radiation-curable basecoat compositions and the radiation-curable topcoat compositions described herein are UV-Vis curable compositions (referred hereafter as UV-Vis-curable basecoat compositions and UV-Vis-curable topcoat compositions).

Preferably the UV-Vis-curable basecoat compositions described herein and the UV-Vis-curable topcoat compositions described herein independently comprise a) a binder compound that comprises oligomers (also referred in the art as prepolymers), preferably selected from the group consisting of radically curable compounds, cationically curable compounds and mixtures thereof. Cationically curable compounds are cured by cationic mechanisms including the activation by energy of one or more photoinitiators that liberate cationic species, such as acids, which in turn initiate the polymerization of the binder compound(s). Radically curable compounds are cured by free radical mechanisms including the activation by energy of one or more photoinitiators that liberate free radicals, which in turn initiate the polymerization of the binder compound(s).

Preferably, the binder compound a) includes oligomers selected from the group consisting of oligomeric(meth) acrylates, vinyl and propenyl ethers, epoxides, oxetanes, tetrahydrofuranes, lactones and mixtures thereof, and more preferably the binder compound is selected from the group consisting of epoxy(meth)acrylates, (meth)acrylated oils, polyester(meth)acrylates, aliphatic or aromatic urethane (meth)acrylates, silicone(meth)acrylates, amino(meth)acrylates, acrylic(meth)acrylates, cycloaliphatic epoxides, vinyl ethers and mixtures thereof, b) optionally a second binder compound selected from the group consisting of monomeric acrylates, such as for example, trimethylolpropane triacrylate (TMPTA), pentaerytritol triacrylate (PTA), tripropyleneglycoldiacrylate (TPGDA), dipropyleneglycoldiacrylate (DPGDA), hexanediol diacrylate (HDDA) and their polyethoxylated equivalents, such as for example, polyethoxylated trimethylolpropane triacrylate, polyethoxylated pentaerythritol triacrylate, polyethoxylated tripropyleneglycol diacrylate, polyethoxylated dipropyleneglycol diacrylate and polyethoxylated hexanediol diacrylate, and c) one or more photoinitiators. The term "(meth)acrylates" refers to methacrylates and/or acrylates. In the case where the UV-Vis curable composition comprises a binder compound selected from the group consisting of cycloaliphatic epoxides, one or more reactive diluents, preferably trimethylolpropane oxetane (TMPO), may be further comprised in said composition(s) so as to improve the UV-Vis curing speed.

UV-Vis curing of a monomer, oligomer or prepolymer may require the presence of one or more photoinitiators and may be effected in a number of ways. As known by those skilled in the art, the one or more photoinitiators are selected according to their absorption spectra and are selected to fit with the emission spectra of the radiation source. As mentioned above, UV-Vis curing may be done by a free radical mechanism, a cationic mechanism or a combination thereof. For example, a binder compound selected from the group consisting of epoxides, oxetanes, tetrahydrofuranes, lactones, vinyl and propenyl ethers and mixtures thereof is typically UV-Vis cured through a cationic mechanism. Depending of the binder compound(s) comprised in the UV-Vis-curable composition, different photoinitiators might be used. Suitable examples of cationic photoinitiators are known to the skilled person and include without limitation onium salts such as organic iodonium salts (e.g., diaryl iodoinium salts), oxonium (e.g., triaryloxonium salts) and sulfonium salts (e.g., triarylsulphonium salts). Suitable examples of free radical photoinitiators are known to the skilled person and include without limitation acetophenones, benzophenones, alpha-aminoketones, alpha-hydroxyketones, phosphine oxides and phosphine oxide derivatives and benzyldimethyl ketals. Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. Typical examples of suitable photosensitizers include without limitation isopropyl-thioxanthone (ITX), 1-chloro-2-propoxy-thioxanthone (CPTX), 2-chloro-thioxanthone (CTX) and 2,4-diethyl-thioxanthone (DETX) and mixtures thereof. The binder compound comprised in the radiation-curable basecoat composition and in the radiation-curable topcoat composition is preferably independently present in an amount from about 10 to about 90 weight percent, more preferably from about 20 to about 85, the weight percents being based on the total weight of the radiation-curable basecoat composition or the radiation-curable topcoat composition as the case may be.

The one or more photoinitiators comprised in the radiation-curable basecoat compositions and in the radiation-curable topcoat compositions described herein are preferably independently present in an amount from about 0.1 to about 20 weight percent, more preferably about 1 to about 15 weight percent, the weight percents being based on the total weight of the radiation-curable basecoat composition or the radiation-curable topcoat composition as the case may be.

The radiation-curable basecoat compositions disclosed herein and the radiation-curable topcoat compositions described herein may further comprise one or more additives including without limitation compounds and materials that are used for adjusting physical and chemical parameters of the composition such as the viscosity (e.g., solvents and surfactants), the consistency (e.g., anti-settling agents, fillers and plasticizers), the foaming properties (e.g., antifoaming agents), the lubricating properties (waxes), UV stability (photosensitizers and photostabilizers) and adhesion properties, etc. Additives described herein may be present in the radiation-curable basecoat compositions and in the radiation-curable topcoat compositions disclosed herein in amounts and in forms known in the art, including in the form of so-called nano-materials where at least one of the dimensions of the particles is in the range of 1 to 1000 nm.

With the aim of providing a good quality and resistant tactile pattern, the radiation-curable basecoat composition may further comprise one or more surface additives. The one or more surface additives may be present in the composition as a polymerizable compound, as a polymeric additive or a combination thereof. The one or more surface additives are preferably selected from the group consisting of dimethylsiloxane-containing compounds including polymers and copolymers of dimethylsiloxane, copolymers of dimethylsiloxane, dimethylsiloxane-modified polyethers, dimethylsiloxane modified polyesters; polymers and copolymers of silicone-modified (meth)acrylate; silicone glycol copolymers; epoxy-silanes including (meth)acryl-oxyalkylalkoxysilanes, (meth) acryloxyalkylalkoxyalkyl silanes, vinyltrimethoxysilanes, vinyltriethoxysilanes, vinyltriisopropoxysilanes, aryltriethoxysilanes, vinylmethyldimethoxysilane, vinylmethyldiethoxysilane and vinyltris (2-methoxyethoxy) silanes; epoxy-functional silane compounds (e.g., [gamma]-glycidoxypropyl trimethoxysilane, lgammal-glycidoxypropyl triethoxysilane, [beta]-glycidoxyethyl trimethoxysilane, [gamma]-(3,4-epoxy-cyclohexyl) propyl) and polymers and copolymers thereof; polymers and copolymers of fluorinated ethylene including polytetrafluoroethylene, polyvinylfluoride, polyvinylidene fluoride; fluorinated ethylene/propylene copolymers and ethylene/tetrafluoroethylene copolymers; polymers and copolymer of fluorinated (meth)acrylates (examples of fluorinated (meth)acrylate include of 2,2,2-trifluoroethyl-[alpha]-fluoroacrylate (TFEFA), 2,2,2-trifluoroethyl-methacrylate (TFEMA), 2,2,3,3-tetrafluoropropyl-[alpha]-fluoroacrylate (TFPFA), 2,2,3,3-tetrafluoropropyl-methacrylate (TFPMA), 2,2,3,3,3-pentafluoropropyl-[alpha]-fluoroacrylate (PFPFA), 2,2,3,3,3-pentafluoropropyl-methacrylate (PFPMA), 1H,1H-perfluoro-n-octyl acrylate, 1H,1H-perfluoro-n-decyl acrylate, 1H,1H-perfluoro-n-octyl methacrylate, 1H,1H-perfluoro-n-decyl methacrylate, 1H,1H,6H,6H-perfluoro-1,6-hexanediol diacrylate, 1H,1H,6H,6H-perfluoro-1,6-hexanediol dimethacrylate, 2-(N-butylperfluorooctane-sulfonamido)-ethyl acrylate, 2-(N-ethyl perfluorooctanesulfonamido)ethyl acrylate, 2-(N-ethyl perfluorooctanesulfonamido)ethyl methacrylate and $C_8F_{17}CH_2CH_2OCH_2CH_2$—OOC—CH═$CH_2$ and $C_8F_{17}CH_2CH_2OCH_2CH_2$—OOC—C($CH_3$)═$CH_2$); and perfluoro(alkyl vinyl ether)s. When present, the one or more surface additives are preferably present in an amount from about 1 to about 25 weight percent, more preferably from about 2 to about 15 weight percent, the weight percents being based on the total weight of the radiation-curable basecoat composition.

The radiation-curable basecoat compositions and/or the radiation-curable topcoat compositions described comprise one or more machine readable feature substances independently selected from the group consisting of cholesteric liquid crystal pigments, luminescent compounds, infrared-absorbing compounds, magnetic compounds and mixtures thereof. The term "machine readable feature substance" refers to a security substance that bears information that becomes visible when using a machine, device, detector or other external aid, such as for example, a circularly polarizing filter (in the case cholesteric liquid crystal pigments as machine readable security substance) and a UV-lamp (in the case of a luminescent compound). Machine readable feature substances comprised in a security feature or security document comprising said security feature as machine detectable security elements require a detector or other external aid to provide the required condition for verification of the security document comprising said security element.

Preferred ranges of the one or machine readable feature substances comprised in the radiation-curable basecoat composition and/or in the radiation-curable topcoat composition depend on said substances. For example, cholesteric liquid crystal pigments are preferably present in an amount from about 5 to about 30 weight percent, luminescent compounds are preferably present in an amount from about 0.1 to about 50 weight percent, infrared-absorbing compounds are preferably present in an amount from about 1 to about 50 weight percent and magnetic compounds are preferably present in an amount from about 5 to about 70 weight percent, the weight percents being based on the total weight of the radiation-curable basecoat composition or the radiation-curable topcoat composition as the case may be.

Liquid crystals in the cholesteric phase exhibit a molecular order in the form of a helical superstructure perpendicular to the longitudinal axes of its molecules. The helical superstructure is at the origin of a periodic refractive index modulation throughout the liquid crystal material, which in turn results in a selective transmission/reflection of determined wavelengths of light (interference filter effect). Cholesteric liquid crystal polymers can be obtained by subjecting one or more crosslinkable substances (nematic compounds) with a chiral phase to orientation. Cholesteric liquid crystal materials may then be shaped to cholesteric liquid crystal pigments by subsequently comminuting the polymer to the desired particle size. The term "pigment" is to be understood according to the definition given in DIN 55943: 1993-11 and DIN EN 971-1: 1996-09. Pigments are materials in powder or flake form which are —contrary to dyes—not soluble in the surrounding medium. The term pigment also encompasses flakes. Flakes have first and second parallel planar surfaces, which allow a parallel orientation of the entire flake to the surface of the underlying substrate or layer and to other flakes. Flakes are typically produced from sheets which are comminuted to the desired flake size, and causing only the edges, i.e. the sides perpendicular to the first and second surfaces, to be of irregular contour.

The particular situation of the helical molecular arrangement leads to cholesteric liquid crystal materials exhibiting the property of dispersing unpolarized incident light into components with different polarization, i.e. the reflected light to be left-hand or right-hand circularly polarized, depending on the sense of rotation of the helices. The pitch can be tuned in particular by varying selectable factors including the temperature and solvents concentration, by changing the nature of the chiral component(s) and the ratio of nematic and chiral compounds. Crosslinking under the influence of UV radiation freezes the pitch in a predetermined state by fixing the desired helical form so that the color of the resulting cholesteric liquid crystal materials is no longer depending on external factors such as the temperature. Since the human eye is unable to detect the polarization state of the light it is receiving, such as the circular polarization effect of cholesteric liquid crystal pigments, a device, such as for example a light-polarizing filter, is required for the detection of said polarization state. Typically, the viewing equipment comprises a pair of circularly polarized filters, a left circular polarized filter and a right circular polarized filter. Examples of films and pigments made from cholesteric liquid crystal materials and their preparation are disclosed in U.S. Pat. No. 5,211,877; U.S. Pat. No. 5,362,315 and U.S. Pat. No. 6,423,246 and in EP-1 213 338 A1; EP-1 046 692 A1 and EP-0 601 483 A1, the respective disclosures of which are incorporated by reference herein. Pigments made from multilayers of cholesteric liquid crystal polymers may also be suitable for embodiments of the present disclosure. Examples of such cholesteric liquid crystal pigments are disclosed in WO 2008/000755 A1, which is incorporated by reference. When the one or machine readable feature substances comprised in the radiation-curable basecoat composition and/or in the radiation-curable topcoat composition are cholesteric liquid crystal pigments, they may be selected from left-handed, right-handed circularly polarizing materials and combinations (e.g., double-handed circularly polarizing materials) thereof. As known to those skilled in the art, compositions comprising cholesteric liquid crystal pigments may be replaced by a cholesteric liquid crystal coating.

In addition to the semi-covert security feature, which is visible or detectable only with the help of a light-polarizing filter, cholesteric liquid crystal pigments exhibit visible optical properties including the optically variable effect, i.e. the visible color shifting effect with changing viewing angle as an overt (i.e. visible to the unaided human eye) security feature. In one embodiment of the present disclosure, the machine readable feature substance combines and exhibits an overt security feature (i.e., visible to the unaided human eye) in addition to its machine readability security feature, i.e. semi-covert or covert security feature. As mentioned above, optical characteristics of cholesteric liquid crystal pigments include an interference effect. To generate or reveal color interference effect and most strong colorshift effects, compositions comprising cholesteric liquid crystal pigments and layers made thereof are preferably applied directly or indirectly to an absorbing surface or to a background, preferably a sufficiently dark, and even preferably a black surface or background. The term "absorbing surface" refers to a layer that absorbs at least part of the visible spectrum of light, preferably to a surface of a dark color, most preferably to a black surface. According to one embodiment of the present disclosure, the substrate of the security features described herein is an absorbing surface and no further additional layer or coating is required to visually observe without any machine or device the color-shifting properties of cholesteric liquid crystal pigments. According to another embodiment of the present disclosure, the substrate of the security features described herein is not an absorbing layer and, therefore, the security document described herein further comprises an additional sufficiently dark and preferably a black background between the substrate and the radiation-cured basecoat. In the presence of a dark background, the dark background is applied to the substrate, prior to the application of the radiation-curable basecoat composition. Typical processes used to apply the dark background include without limitation inkjet, offset, screen printing, flexo printing and rotogravure.

Luminescent compounds are widely used as marking materials in security applications. Luminescent compounds may be inorganic (inorganic host crystals or glasses doped with luminescent ions), organic or organometallic (complexes of luminescent ion(s) with organic ligand(s)) substances. Luminescent compounds can absorb certain types of energy acting upon them and subsequently emit at least partially this absorbed energy as electromagnetic radiation. Luminescent compounds are detected by exposing with a certain wavelength of light and analyzing the emitted light. Down-converting luminescent compounds absorb electromagnetic radiation at a higher frequency (shorter wavelength) and at least partially re-emit it at a lower frequency (longer wavelength). Up-converting luminescent compounds absorb electromagnetic radiation at a lower frequency and at least partially re-emit part of it at a higher frequency. Light emission of luminescent materials arises from excited states in atoms or molecules. The radiative decay of such excited states has a characteristic decay time, which depends on the material and can range from $10^{-9}$ seconds up to various hours. Both fluorescent and phosphorescent compounds are suitable for the realization of machine-readable feature. In the case of phosphorescent compounds, measurement of decay characteristics may also be carried out and used as a machine-readable feature. Luminescent compounds in pigment form have been widely used in inks (see U.S. Pat. No. 6,565,770, WO 2008/033059 A2 and WO 2008/092522 A1). Examples of luminescent compounds include among others sulphides, oxysulphides, phosphates, vanadates, etc. of non-luminescent cations, doped with at least one luminescent cation chosen from the group consisting of transition-metal and the rare-earth ions; rare earth oxysulfides and rare-earth metal complexes such as those described in WO 2009/005733 A2 or in U.S. Pat. No. 7,108,742. Examples of inorganic compounds materials include without limitation $La_2O_2S$:Eu, $ZnSiO_4$:Mn, and $YVO_4$:Nd.

Magnetic compounds are widely used as marking materials in security applications and have been used since long in the field of banknote printing, to confer to the printed currency an additional, covert, security element that can be easily sensed by electronic measuring tools. Magnetic compounds exhibit particular, detectable magnetic properties of the ferromagnetic or ferrimagnetic type and include permanent magnetic compounds (hard-magnetic compounds with coercivity Hc>1000 A/m) and magnetizable compounds (soft-magnetic compounds with coercivity Hc<=1000 A/m according to IEC60404-1 (2000)). Typical examples of magnetic compounds include iron, nickel, cobalt, manganese and their magnetic alloys, carbonyl iron, chromium dioxide $CrO_2$, magnetic iron oxides (e.g. $Fe_2O_3$; $Fe_3O_4$), magnetic ferrites $M(II)Fe(III)_2O_4$ and hexaferrites $M(II)Fe(III)_{12}O_{19}$, the magnetic garnets $M(III)_3Fe(III)_5O_{12}$ (such as Yttrium iron garnet $Y_3Fe_5O_{12}$) and their magnetic isostructural substitution products and particles with permanent magnetization (e.g. $CoFe_2O_4$). Magnetic pigments particles comprising a magnetic core material which is surrounded (coated) by at least one layer of another material such as those described in WO 2010/115986 A2 may also be used for embodiments of the present disclosure.

Infrared (IR) absorbing compounds, i.e. compounds absorbing in the near-infrared (NIR) range of the electromagnetic spectrum, most generally in the 700 nm to 2500 nm wavelength range, are widely known and used as marking materials in security applications to confer to the printed documents an additional, covert, security element which help their authentication. For example, IR features have been implemented in banknotes for use by automatic currency processing equipment, in banking and vending applications (automatic teller machines, automatic vending machines, etc.), in order to recognize a determined currency bill and to verify its authenticity, in particular to discriminate it from replicas made by color copiers. IR absorbing compounds include IR absorbing inorganic compounds, glasses comprising substantial amounts of IR-absorbing atoms or ions or entities which display IR-absorption as a cooperative effect, IR absorbing organic compounds and IR absorbing organometallic compounds (complexes of cation(s) with organic ligand(s), wherein either the separate cation and/or the separate ligand, or both in conjunction, have IR-absorbing properties). Typical examples of IR absorbing compounds include among others carbon black, quinone-diimmonium or aminium salts, polymethines (e.g., cyanines, squaraines, croconaines), phthalocyanine or naphthalocyanine type (IR-absorbing pi-system), dithiolenes, quaterrylene diimides, metal (e.g., transition metals or lanthanides) phosphates, lanthanum hexaboride, indium tin oxide, antimony tin oxide in nano-particulate form and doped tin(IV) oxide (cooperative property of the $SnO_4$ crystal). IR absorbing compounds comprising a transition element compound and whose infrared absorption is a consequence of electronic transitions within the d-shell of transition element atoms or ions, such as those described in WO 2007/060133 A2, may also be used for embodiments of the present disclosure.

The radiation-curable basecoat compositions and/or the radiation-curable topcoat compositions described herein may further comprise one or more security feature substances, preferably one or more overt security feature substances. For example, both the radiation-curable basecoat compositions and the radiation-curable topcoat compositions described herein comprise the one or more machine readable feature substances described herein and one composition of them or both of them further comprise one or more overt security feature substances. Alternatively, one of the radiation-curable basecoat composition and the radiation-curable topcoat composition comprises one or more machine readable feature substances and the other composition comprises one or more overt security feature substances.

Suitable overt security feature substances for embodiments of the present disclosure change appearance in a reversible, predictable and reproducible manner by the application of heat, by variation in the angle of viewing, or by the adjustment of lighting conditions. Preferably, the one or more overt security feature substances are selected from the group consisting of iridescent pigments, thin-film interference pigments, magnetic or magnetizable thin-film interference pigments, interference-layer coated particles, holographic pigments, thermochromic pigments, photochromic pigments, metameric materials and mixtures thereof. More preferably, the one or more overt security feature substances are selected from the group consisting of iridescent pigments, thin-film interference pigments, magnetic or magnetizable thin-film interference pigments, metameric materials and mixtures thereof. When present in the radiation-curable basecoat composition or in the radiation-curable topcoat composition, the one or more security feature substances are preferably independently present in an amount for about 5 to 30 about weight percent, the weight percent being based on the total weight of the radiation-curable basecoat composition or the radiation-curable topcoat composition. The radiation-curable basecoat compositions and/or the radiation-curable topcoat compositions described herein may further comprise one or more taggants and/or forensic markers.

According to one embodiment of the present disclosure, the radiation-curable basecoat composition and the radiation-curable topcoat composition described herein are metameric inks. The use of metameric ink pairs might be used as an additional line of defense against counterfeiting and illegal reproduction attempts and are good visual security printing elements that can be easily and quickly verified. The use of metameric inks as an anti-counterfeiting feature or security device in security documents is also described in GB-1407065 A. Metameric inks include a pair of inks formulated to look identical under one set of illuminating and/or viewing conditions, but which do not match and appear as different colors when any factor affecting the observed color is changed. An example of metameric inks includes a system of two components (i.e., the radiation-cured basecoat and the radiation-cured topcoat), one being made of an optically variable ink and the other being made of a color-constant ink (i.e., a material with constant reflection), wherein the optically variable component and the color-constant component have a matching color under one angle of and different colors at all other angles. Another example of metameric includes a system of two components (i.e. the radiation-cured basecoat and the radiation-cured topcoat), one being made of an optically variable ink and the other being made of another optically variable ink, wherein the optically variable components have a matching color under one angle of incidence and different colors at all other angles. Another example of metameric inks includes a system of two components (i.e., the radiation-cured basecoat and the radiation-cured topcoat) wherein they appear to be of an identical color when viewed under a specific lighting condition, but when viewed in different lighting conditions, they appear to have different colors, so that one component is distinguishable from the other.

The radiation-curable basecoat compositions and the radiation-curable topcoat compositions described herein may be prepared by dispersing or mixing the one or more security feature substances when present, the one or more machine readable feature substances when present, and the one or more additives when present in the presence of a binder compound and optionally of a second binder compound, thus forming liquid or pasty inks. The one or more photoinitiators may be added to the composition either during the dispersing or mixing step of all other ingredients, or may be added at a later stage, i.e., after the formation of the liquid or pasty inks. Binder compounds and additives are typically chosen among those known in the art and depend on the coating or printing process used to apply the basecoat on the substrate.

The radiation-curable basecoat compositions described herein are applied on the substrate described herein by a coating or printing method selected from the group consisting of inkjet, offset, screen printing, flexo printing and rotogravure; with screen printing, flexo printing and rotogravure being more preferred, and rotogravure being even more preferred. As known by those skilled in the art, inkjet and offset printings may not be used to apply compositions comprising pigments and/or particles having a large particle size. The radiation-curable topcoat compositions described herein are applied on the radiation-cured basecoat by a process selected from the group consisting of screen printing, flexo printing and rotogravure. Preferably, the radiation-curable topcoat compositions described herein are applied by rotogravure.

As known by those skilled in the art, the term rotogravure refers to a printing process which is described for example in "Handbook of print media", Helmut Kipphan, Springer Edition, page 48. Rotogravure is a printing process wherein the image elements are engraved into the surface of the cylinder. The non-image areas are at a constant original level. Prior to printing, the entire printing plate (non-printing and printing elements) is inked and flooded with ink. Ink is removed from the non-image by a wiper or a blade before printing, so that ink remains only in the cells. The image is transferred from the cells to the substrate by a pressure typically in the range of 2 to 4 bars and by the adhesive forces between the substrate and the ink. The term rotogravure does not encompass intaglio printing processes (also referred in the art as engraved steel die or copper plate printing processes) which rely for example on a different type of ink. Typically, inks suitable for intaglio printing processes have a viscosity in the range of 5 to 60 Pa s at 40° C. and 1000 $s^{-1}$ whereas inks suitable for rotogravure are low viscosity inks, i.e. viscosities in the range of 15 to 110 s at room temperature according to DIN 53211-4 mm (corresponding to a range of about 5 to 50 mPa s).

According to one embodiment of the present disclosure, the process for manufacturing a security feature comprising a tactile pattern comprises the steps of:

i) applying on the substrate described herein a radiation-curable basecoat composition such as those described herein and comprising one or more machine readable feature substances selected from the group consisting of cholesteric liquid crystal pigments, luminescent compounds, infrared-absorbing compounds, magnetic compounds and mixtures thereof, by a coating or printing process preferably selected from the group consisting of screen printing, flexo printing and rotogravure, more preferably by rotogravure;

ii) at least partially or fully radiation-curing said radiation-curable basecoat composition so as to form a radiation-cured basecoat;

iii) applying in the form of indicia on the radiation-cured basecoat obtained under step ii) a radiation-curable topcoat composition such as those described herein by a coating or printing process selected from the group consisting of screen printing, flexo printing and rotogravure, preferably by rotogravure; preferably the radiation-curable topcoat composition comprises one or more overt security feature substances selected from the group consisting of iridescent pigments, thin-film interference pigments, magnetic or magnetizable thin-film interference pigments, interference-layer coated particles, holographic pigments, thermochromic pigments, photochromic pigments, metameric materials and mixtures thereof;

iv) radiation-curing the radiation-curable topcoat composition so as to form a radiation-cured topcoat;

wherein the radiation-cured basecoat has a surface energy at least 15 mN/m, preferably at least 20 mN/m, and more preferably between 15 and 35 mN/m, less than the surface energy of the radiation-cured topcoat.

According to another embodiment of the present disclosure, the process for manufacturing a security feature comprising a tactile pattern comprises the steps of:

i) applying on the substrate described herein a radiation-curable basecoat composition such as those described herein by a coating or printing process preferably selected from the group consisting of screen printing, flexo printing and rotogravure, more preferably by rotogravure; preferably, the radiation-curable basecoat composition comprises one or more overt security feature substances selected from the group consisting of iridescent pigments, thin-film interference pigments, magnetic or magnetizable thin-film interference pigments, interference-layer coated particles, holographic pigments, thermochromic pigments, photochromic pigments, metameric materials and mixtures thereof;

ii) at least partially or fully radiation-curing said radiation-curable basecoat composition so as to form a radiation-cured basecoat;

iii) applying in the form of indicia on the radiation-cured basecoat obtained under step ii) a radiation-curable topcoat composition, said radiation-curable topcoat composition comprising one or more machine readable feature substances selected from the group consisting of cholesteric liquid crystal pigments, luminescent compounds, infrared-absorbing compounds, magnetic compounds and mixtures thereof, by a coating or printing process selected from the group consisting of screen printing, flexo printing and rotogravure, preferably by rotogravure;

iv) radiation-curing the radiation-curable topcoat composition so as to form a radiation-cured topcoat;

wherein the radiation-cured basecoat has a surface energy at least 15 mN/m, preferably at least 20 mN/m, and more preferably between 15 and 35 mN/m, less than the surface energy of the radiation-cured topcoat.

According to another embodiment of the present disclosure, the process for manufacturing a security feature comprising a tactile pattern comprises the steps of:

i) applying on the substrate described herein a radiation-curable basecoat composition such as those described herein and comprising one or more machine readable feature substances selected from the group consisting of cholesteric liquid crystal pigments, luminescent compounds, infrared-absorbing compounds, magnetic compounds and mixtures thereof, by a coating or printing process preferably selected from the group consisting of screen printing, flexo printing and rotogravure, more preferably by rotogravure;

ii) at least partially or fully radiation-curing said radiation-curable basecoat composition so as to form a radiation-cured basecoat;

iii) applying in the form of indicia on the radiation-cured basecoat obtained under step ii) a radiation-curable topcoat composition such as those described herein, said radiation-curable topcoat composition comprising one or more machine readable feature substances selected from the group consisting of cholesteric liquid crystal pigments, luminescent compounds, infrared-absorbing compounds, magnetic compounds and mixtures thereof, by a coating or printing process selected from the group consisting of screen printing, flexo printing and rotogravure, preferably by rotogravure;

iv) radiation-curing the radiation-curable topcoat composition so as to form a radiation-cured topcoat;

wherein the radiation-cured basecoat has a surface energy at least 15 mN/m, preferably at least 20 mN/m, and more preferably between 15 and 35 mN/m, less than the surface energy of the radiation-cured topcoat, and wherein, the one or more machine readable feature substances comprised in the radiation-curable basecoat composition and in the radiation-curable topcoat composition may be the same in terms of chemistry but are preferably different in terms of non-visibly distinctive properties that are authenticated by the use of a particular equipment. For example, when the one or more machine readable feature substances comprised in the radiation-curable basecoat composition and in the radiation-curable topcoat composition are the cholesteric liquid crystal pigments described herein, they may be different in terms of light polarization; one type of cholesteric liquid crystal pigments is a left-handed material and the other type of cholesteric liquid crystal pigments is a right-handed material or one type of cholesteric liquid crystal pigments is a left-handed material and the other type of cholesteric liquid crystal pigments includes a mixture of right-handed material and left-handed material or one type of cholesteric liquid crystal pigments is a right-handed material and the other type of cholesteric liquid crystal pigments includes a mixture of right-handed material and left-handed material. In such cases, both materials may show the same appearance under normal illumination conditions if they exhibit the same colorshifting properties, but can be recognized as different materials through the use of a circularly polarized filter.

When the one or more machine readable feature substances are comprised in the radiation-cured topcoat in the form of indicia, the tactile pattern further exhibits machine detectable characteristics and in such cases, the processes described herein for manufacturing security features comprising indicia that advantageously combine tactile readable characteristics with a machine readable feature substance therefore exhibit a strongly improved forgery-proofness due to the combination of tactilely perceptible features and semi-covert or covert features.

According to another embodiment of the present disclosure, the process for manufacturing a security feature comprising a machine readable tactile pattern according to the present disclosure and security documents obtained therefrom, comprises and combines a radiation-cured basecoat and a radiation-cured topcoat, wherein a) the radiation-cured basecoat is made of the radiation-curable basecoat compositions comprising one or more overt security feature substances selected from the group consisting of iridescent pigments, thin-film interference pigments, magnetic or magnetizable thin-film interference pigments and mixtures thereof, preferably in an amount from about 5 to about 30 weight percent; the binder compound described above and preferably in an amount from about 20 to about 85 weight percent; optionally the second binder compound described above and; the one or more photoinitiators described above and preferably in an amount from about 1 to about 15 weight percent; and optionally the one or more additives described above; the weight percentages being based on the total weight of the radiation-curable basecoat compositions, and wherein b) the radiation-cured topcoat is made of the radiation-curable topcoat compositions comprising one or more machine readable feature substances selected from the group consisting of cholesteric liquid crystal pigments such as those described above, preferably in an amount from about 5 to about 30 weight percent; the binder compound described above and preferably in an amount from about 20 to about 85 weight percent; optionally the second binder compound described above and, when present; the one or more photoinitiators described above and preferably in an amount from about 1 to about 15 weight percent; and optionally the one or more additives described above; the weight percentages being based on the total weight of the radiation-curable topcoat compositions.

According to another embodiment of the present disclosure, the process for manufacturing a security feature comprising a machine readable tactile pattern according to the present disclosure and security documents obtained therefrom, comprises and combines a radiation-cured basecoat and a radiation-cured topcoat, wherein a) the radiation-cured basecoat is made of the radiation-curable basecoat compositions comprising one or more overt security feature substances selected from the group consisting of iridescent pigments, thin-film interference pigments, magnetic or magnetizable thin-film interference pigments and mixtures thereof such as those described above, preferably in an amount from about 5 to about 30 weight percent; the binder compound described above and preferably in an amount from about 20 to about 85 weight percent; optionally the second binder compound described above and, when present; the one or more photoinitiators described above and preferably in an amount from about 1 to about 15 weight percent; and optionally the one or more additives described above; the weight percentages being based on the total weight of the basecoat compositions, and wherein b) the radiation-cured topcoat is made of the radiation-curable topcoat compositions comprising one or more machine readable feature substances selected from the group consisting of luminescent compounds such as those described, preferably in an amount from about 0.1 to about 50 weight percent; the binder compound described above and preferably in an amount from about 20 to about 85 weight percent; optionally the second binder compound described above and; the one or more photoinitiators described above and preferably in an amount from about 1 to about 15 weight percent; and optionally the one or more additives described above; the weight percentages being based on the total weight of the radiation-curable topcoat compositions.

According to another embodiment of the present disclosure, the process for manufacturing a security feature comprising a machine readable tactile pattern according to the present disclosure and security documents obtained therefrom, comprises and combines a radiation-cured basecoat and a radiation-cured topcoat, wherein a) the radiation-cured basecoat is made of the radiation-curable basecoat compositions comprising one or more security feature substances selected from the group consisting of cholesteric liquid crystals pigments such as those described above, preferably in an amount from about 5 to about 30 weight percent; the binder compound described above and preferably in an amount from about 20 to about 85 weight percent; optionally the second binder compound described above and; the one or more photoinitiators described above and preferably in an amount from about 1 to about 15 weight percent; and optionally the one or more additives described above; the weight percentages being based on the total weight of the basecoat compositions, and wherein b) the radiation-cured topcoat is made of the radiation-curable topcoat compositions comprising one or more machine readable feature substance selected from the group consisting of cholesteric liquid crystals pigments, preferably in an amount from about 5 to about 30 weight percent; the binder compound described above and preferably in an amount from 20 to 85 weight percent; optionally the second binder compound described above and; the one or more photoinitiators described above and preferably in an amount from about 1 to about 15 weight percent; and optionally the one or more additives described above; the weight percentages being based on the total weight of the radiation-curable topcoat compositions. As described above, the cholesteric liquid crystals pigments comprised in the radiation-curable basecoat compositions and the radiation-curable topcoat compositions described above may exhibit a difference in terms of machine readability characteristics, for example they may exhibit same or different colorshift properties, i.e. similar or same overt properties, but exhibit different light polarization.

According to another embodiment of the present disclosure, the process for manufacturing a security feature comprising a machine readable tactile pattern according to the present disclosure and security documents obtained therefrom, comprises and combines a radiation-cured basecoat and a radiation-cured topcoat, wherein a) the radiation-cured basecoat is made of the radiation-curable basecoat compositions comprising one or more machine readable feature substance selected from the group consisting of cholesteric liquid crystals pigments, preferably in an amount from about 5 to about 30 weight percent; the binder compound described above and preferably in an amount from about 20 to about 85 weight percent; optionally the second binder compound described above and; the one or more photoinitiators described above and preferably in an amount from about 1 to about 15 weight percent; and optionally the one or more additives described above; the weight percentages being based on the total weight of the radiation-curable basecoat compositions, and wherein b) the radiation-cured topcoat is made of the radiation-curable topcoat compositions comprising one or machine readable feature substances selected from the group consisting of luminescent compounds such as those described above, preferably in an amount from about 0.1 to about 50 weight percent; the binder compound described above and preferably in an amount from about 20 to about 85 weight percent; optionally the second binder compound described above and; the one or more photoinitiators described above and preferably in an amount from about 1 to about 15 weight percent; and optionally the one or more additives described above; the weight percentages being based on the total weight of the radiation-curable topcoat compositions.

As described hereabove, the present disclosure further provides the use the security features described herein for the protection of a security document against counterfeiting or fraud and security documents comprising the security features described herein.

Examples

The present disclosure is now described in greater detail with respect to non-limiting examples.

TABLE 1

| Ingredients | Composition I | Composition II |
|---|---|---|
| amine modified multifunctional acrylated polyether oligomer (sold as Ebecryl ™ 83, Cytec Chemicals) | 82.80 | 81.00 |
| aromatic urethane acrylate oligomer containing ca. 10% of tripropyleneglycol diacrylate (sold as Ebecryl ™ 2003, Cytec Chemicals) | 6.44 | 6.3 |
| 2-methyl-1-[4-(methylthio)phenyl]-2-(4-morpholinyl)-1-propanone (sold as Irgacure ® 907, BASF) | 1.38 | 1.35 |
| thioxanthone (sold as Genocure ® ITX, Rahn) | 0.46 | 0.45 |
| 1:1 mixture of 1-hydroxy-cyclohexyl-phenyl-ketone and benzophenone (sold as Irgacure ® 500, BASF) | 0.92 | 0.90 |
| dimethyl, methyl (polyethylene oxide acetate-capped) siloxane (sold as Dow Corning ® 57, Dow Corning) | 8.00 | — |
| HDDA, hexanediol diacrylate (UCB) | — | 10 |

TABLE 2

| UV-curable basecoat composition | |
|---|---|
| component | amount/wt-% |
| composition I | 80 |
| optically variable pigments with a colorshift from pink to green | 20 |

TABLE 3

| UV-curable topcoat composition | |
|---|---|
| component | amount/wt-% |
| composition II | 80 |
| cholesteric liquid crystal pigments with a colorshift from red to green and left-handed | 20 |

250 g of the UV-curable basecoat composition and 250 g of the UV-curable topcoat compositions were prepared by mixing the ingredients described in Tables 1 to 3. Mixing at room temperature was done with a dispersing propeller (stainless steel 4.0 cm diameter) at a speed of 2000 rpm for a period of ten minutes.

The UV-curable basecoat composition was applied to a paper substrate (supplied by Gascognes Laminates) so as to form a basecoat by rotogravure at a speed of 50 m/min (TESTACOLOR FTM-145 sold by Norbert Schläfli Engler Maschinen and comprising a cylinder with the following characteristics: chemical engravings, 45 l/cm, 70-80 μm) in the form of rectangular pattern.

After a step of UV-curing the basecoat composition with an off-line UV dryer (supplied by 1ST) comprising a standard mercury UV lamp (Hg-M-250-NA-B) and an iron-doped UV lamp (Hg-M-250-NA-2) at a power of 80% and a conveyor speed of 100 m/min, the UV-curable topcoat composition was applied to the basecoat. The UV-curable topcoat composition was applied by rotogravure (TESTACOLOR FTM-145 sold by Norbert Schläfli Engler Maschinen and comprising a cylinder with the following characteristics: chemical engravings, 55 l/cm, 60 μm) to the UV-cured basecoat so as to form a topcoat in the form of indicia and UV-cured with the same machine as described above.

The surface energy of the radiation-cured topcoat and the radiation-cured basecoat was determined from static contact angle measurements with a standard sessile drop arrangement using a Krüss DSA100 instrument. Contact angles of water, ethylene glycol and diiodomethane deposited on the radiation-cured topcoat and the radiation-cured basecoat were measured to determine the surface energy. All measurements were taken at 22° C. and a relative humidity of 16%. Contact angles given in Table 4 are average values of three measurements. Contact angles were determined with a constant drop volume of 3.0 μL for water and ethylene glycol and 1.5 μL for diiodomethane.

The surface energies were calculated by using the Owen-Wendt-Rabel-Kaelbe (OWRK) theory. Results are presented in Table 4.

TABLE 4

| | Contact angle [°] | | | Surface energy γ[mN/m] | | |
|---|---|---|---|---|---|---|
| | water | ethylene glycol | diiodo-methane | $\gamma^{dispersive}$ | $\gamma^{polar}$ | γ |
| basecoat | 89.40 ± 0.79 | 83.40 ± 0.44 | 69.10 ± 0.09 | 3.83 ± 0.03 | 21.39 ± 0.01 | 25.22 ± 0.04 |
| topcoat | 65.43 ± 0.47 | 44.00 ± 0.72 | 37.60 ± 0.99 | 9.25 ± 0.07 | 40.81 ± 0.19 | 50.06 ± 0.26 |

After having applied by printing the UV-curable basecoat composition and the UV-curable topcoat composition described in Tables 1 and 2 on the paper substrate, a strong and glossy color shift from pink to green was observed when tilting the printed substrate. The color shift was obtained by the basecoat because the topcoat containing cholesteric liquid crystal pigments was transparent when observed with naked eye. However, when the tactile effect on the printed substrate was felt with the sense of touch, it invited the observer to analyze more into detail the printed substrate. By using an optical viewing equipment comprising a left circular polarizer and a right circular polarizer, the topcoat in the form of indicia made from the UV-curable topcoat composition was revealed through the left circular polarizer only.

The invention claimed is:

1. A process for manufacturing a security feature comprising a tactile pattern, said method comprising:

applying on a substrate a radiation-curable basecoat composition by a process selected from the group consisting of inkjet, offset, screen printing, flexo printing and rotogravure;

at least partially radiation-curing said radiation-curable basecoat composition so as to obtain a radiation-cured basecoat;

applying on the radiation-cured basecoat a radiation-curable topcoat composition in a form of indicia by a process selected from the group consisting of screen printing, flexo printing and rotogravure; and radiation-curing said radiation-curable topcoat composition so as to form a radiation-cured topcoat, wherein at least one of the radiation-curable basecoat composition and the radiation-curable topcoat composition comprises one or more machine readable feature substances independently selected from the group consisting of cholesteric liquid crystal pigments, luminescent compounds, infrared-absorbing compounds, magnetic compounds and mixtures thereof, and wherein the radiation-cured basecoat has a surface energy at least 15 mN/m less than the surface energy of the radiation-cured topcoat.

2. The process according to claim 1, wherein the radiation-curable basecoat composition and the radiation-curable topcoat composition are UV-Vis-curable compositions.

3. The process according to claim 1, wherein the substrate is selected from the group consisting of paper-containing materials, plastic or polymer substrates, composite materials, metals, metalized materials and combinations thereof.

4. The process according to claim 1, wherein at least one of the radiation-curable basecoat composition and the radiation-curable topcoat composition comprises one or more machine readable feature substances and the other of the radiation-curable basecoat composition and the radiation-curable topcoat composition comprises one or more overt security feature substances selected from the group consisting of iridescent pigments, thin-film interference pigments, magnetic or magnetizable thin-film interference pigments, interference-layer coated particles, holographic pigments, thermochromic pigments, photochromic pigments, metameric materials, and mixtures thereof.

5. The process according to claim 4, wherein the other of the radiation-curable basecoat composition and the radiation-curable topcoat composition additionally comprises one or more machine readable feature substances.

6. The process according to claim 1, wherein the radiation-curable basecoat composition and the radiation-curable topcoat composition independently comprise:

a binder compound selected from the group consisting of epoxy(meth)acrylates, (meth)acrylated oils, polyester (meth)acrylates, aliphatic or aromatic urethane(meth) acrylates, silicone(meth)acrylates, amino(meth)acrylates, acrylic(meth)acrylates, cycloaliphatic epoxides, vinyl ethers and mixtures thereof; and one or more photoinitiators.

7. The process according to claim 6, wherein the radiation-curable basecoat composition and the radiation-curable topcoat composition independently further comprise a second binder compound selected from the group consisting of monomeric acrylates.

8. The process according to claim 6, wherein the radiation-curable basecoat composition and the radiation-curable topcoat composition independently further comprise the one or more machine readable feature substance and/or the one or more security feature substances.

9. The process according to claim 6, wherein the radiation-curable basecoat composition and the radiation-curable topcoat composition independently further comprise one or more additives selected from the group consisting of fillers, antifoaming agents, photosensitizers, photostabilizers, emulsifiers, and mixtures thereof.

10. The process according to claim 1, wherein:

the radiation-curable topcoat composition comprises one or more machine readable feature substances selected from the group consisting of cholesteric liquid crystal pigments, and the radiation-curable basecoat composition comprises one or more overt security feature substances selected from the group consisting of iridescent pigments, thin-film interference pigments, magnetic or magnetizable thin-film interference pigments, and mixtures thereof.

11. The process according to claim 1, wherein:

the radiation-curable topcoat composition comprises one or more machine readable feature substances selected from the group consisting of cholesteric liquid crystal pigments, and the radiation-curable basecoat composition comprises one or more machine readable feature substances selected from the group consisting of cholesteric liquid crystal pigments.

12. The process according to claim 11, wherein the cholesteric liquid crystal pigments in the radiation-curable topcoat composition and the cholesteric liquid crystal pigments in the radiation-curable basecoat composition are different in terms of circularly polarized light.

13. The process according to claim 1, wherein:

the radiation-curable topcoat composition comprises one or more machine readable feature substances selected from the group consisting of luminescent compounds, and the radiation-curable basecoat composition comprises one or more overt security feature substances selected from the group consisting of iridescent pigments, thin-film interference pigments, magnetic or magnetizable thin-film interference pigments, and mixtures thereof.

14. The process according to claim 1, wherein:

the radiation-curable topcoat composition comprises one or more machine readable feature substances selected from the group consisting of luminescent compounds, and the radiation-curable basecoat composition comprises one or more machine readable feature substances selected from the group consisting of cholesteric liquid crystal pigments.

15. The process according to claim 1, wherein the radiation-curable basecoat composition and the radiation-curable topcoat composition are metameric inks.

16. The process according to claim 1, wherein the radiation-curable basecoat composition comprises one or more surface additives.

17. The process according to claim 16, wherein the one or more surface additives are in an amount from about 1 to about 25 weight percent, the weight percent being based on a total weight of the radiation-curable basecoat composition.

18. The process according to claim 1, wherein the tactile pattern has a peak to valley distance of at least 20 μm.

19. A use of the security feature formed according to the process of recited in claim 1 for the protection of a security document against counterfeiting or fraud.

20. A security document comprising a security feature having the tactile pattern, wherein the security feature is formed according to the process of claim 1.

21. The process according to claim 1, wherein the at least partially radiation-curing said radiation-curable basecoat composition comprises fully radiation-curing said radiation-curable basecoat composition.

22. A security feature comprising a substrate and a tactile pattern of a radiation-cured basecoat and a radiation-cured topcoat, said radiation-cured topcoat being in the form of indicia and at least partially covering said radiation-cured basecoat, wherein at least one of said radiation-cured basecoat and said radiation-cured topcoat comprises at least one machine-readable feature substance independently selected from the group consisting of cholesteric liquid crystal pigments, luminescent compounds, infrared-absorbing compounds, magnetic compounds, and mixtures thereof, wherein said basecoat has a surface energy of at least 15 mN/m less than the surface energy of the topcoat, and wherein said basecoat and said topcoat are made from radiation-curable compositions.

23. The security feature according to claim 22, wherein the radiation-cured basecoat and the radiation-cured topcoat are respectively made from radiation-curable basecoat composition applied by a process selected from the group consisting of inkjet, offset, screen printing, flexo printing and rotogravure and radiation-curable topcoat composition in a form of indicia applied on the radiation-cured basecoat by a process selected from the group consisting of screen printing, flexo printing and rotogravure, wherein the radiation-cured basecoat has a surface energy at least 15 mN/m less than the surface energy of the radiation-cured topcoat.

24. The security feature according to claim 22, wherein the tactile pattern has a peak to valley distance of at least 20 μm.

* * * * *